US007570772B2

(12) United States Patent
Sørensen et al.

(10) Patent No.: US 7,570,772 B2
(45) Date of Patent: Aug. 4, 2009

(54) MICROPHONE WITH ADJUSTABLE PROPERTIES

(75) Inventors: Per Kokholm Sørensen, Smørum (DK); Frank Engel Rasmussen, Smørum (DK); Karsten Bo Rasmussen, Smørum (DK)

(73) Assignee: Oticon A/S, Smørum (DK)

( * ) Notice: Subject to any disclaimer, the term of this patent is extended or adjusted under 35 U.S.C. 154(b) by 646 days.

(21) Appl. No.: 10/555,763

(22) PCT Filed: May 6, 2004

(86) PCT No.: PCT/DK2004/000321

§ 371 (c)(1),
(2), (4) Date: Nov. 7, 2005

(87) PCT Pub. No.: WO2004/103015

PCT Pub. Date: Nov. 25, 2004

(65) Prior Publication Data

US 2007/0007858 A1 Jan. 11, 2007

(30) Foreign Application Priority Data

May 15, 2003 (DK) ..... 2003 00743

(51) Int. Cl.
*H04R 25/00* (2006.01)

(52) U.S. Cl. ..... 381/175; 381/170

(58) Field of Classification Search ..... 381/170, 381/175, 324, 355, 360, 369
See application file for complete search history.

(56) References Cited

U.S. PATENT DOCUMENTS

| | | | |
|---|---|---|---|
| 3,940,575 | A | 2/1976 | Bauer |
| 4,142,072 | A | 2/1979 | Berland |
| 6,075,867 | A | 6/2000 | Bay et al. |
| 6,160,896 | A | 12/2000 | Macaluso et al. |
| 6,549,635 | B1 | 4/2003 | Gebert |
| 2002/0067663 | A1 | 6/2002 | Loeppert et al. |

FOREIGN PATENT DOCUMENTS

| | | |
|---|---|---|
| EP | 0 982 971 | 3/2000 |

*Primary Examiner*—Brian Ensey
(74) *Attorney, Agent, or Firm*—Dykema Gossett PLLC

(57) ABSTRACT

The invention concerns a microphone with a membrane. The membrane has a first side which is in fluid contact with the surroundings and a second side which is facing a back chamber, where a barometric relief opening or vent opening is provided between the back chamber and the surroundings. According to the invention control means are provided for controlling the barometric relief opening.

15 Claims, 4 Drawing Sheets

MICROPHONE WITH ADJUSTABLE PROPERTIES

BACKGROUND OF THE INVENTION

1. Field of the Invention

The invention concerns a microphone with adjustable properties.

2. The Prior Art

Membrane microphones include a membrane which is placed over a back chamber. Further, these microphones are equipped with a small vent opening ventilating the back chamber to the surroundings. This is necessitated by changing pressure conditions in the atmosphere. This opening is also known as a barometric relief opening.

In many acoustical devices, such as hearing aids, there is a need to control the sensitivity of the microphone especially at low frequencies. This could, as an example work as a remedy against unwanted signals at very low frequencies, in particular wind-induced noise.

One way of decreasing the above-mentioned acoustical low frequency noise from wind noise and other sources is to use a microphone with a large size vent opening from the inside of the microphone to the surrounding air. This effectively short circuits the low frequency signals since the opening will equalize the pressure changes provided that they are sufficiently slowly varying as in the case of low frequency noise.

If the vent opening is small wind-induced noise and other low frequency noises are a problem, whereas a large vent-opening decreases the sensitivity towards wanted low frequency signals. The invention presents a solution to this dilemma.

The vent opening is very important for the properties of any microphone. It is well known by people skilled in the art that the pressure equalization due to the opening may be described by a simple 1. order high pass filter function as described in EP Patent publication EP 0 982 971 A2, $$L(\omega) = \frac{j\frac{\omega}{\omega_l}}{1 + j\frac{\omega}{\omega_l}}$$

where $\omega_l$ is the corner frequency for the low frequency rolloff. The corner frequency may move to higher or lower frequency according to the size of the vent-opening as described in the above cited publication. Hence the size of the opening determines the compromise between sensitivity towards useful signals versus noise.

Situations also exist where the microphone sensitivity towards low frequencies should be changeable according to the environment in which the microphone works.

One example of such a situation is the already mentioned wind noise situation, where the microphone is to react to increase in wind noise. Another example is a microphone sensing the acoustic signals existing in the ear canal of a wearer of the hearing aid. Such a microphone may be located in the hearing aid on the side pointing into the ear. This additional microphone may be useful in connection with active countermeasures against the experience of occlusion due to the hearing aid as described in Danish patent application PA 2002 01292. Such an internal microphone works in a special environment where the individual size of the residual cavity behind the hearing aid and in front of the eardrum affects the optimum low frequency response of the microphone system. Therefore a microphone with an adjustable vent opening would form an important part of the anti-occlusion system.

A further relevant application is when using two or more microphones together in order to obtain directional patterns. In such cases it is important that all microphones have the same high pass filter function. Any deviation in filtering characteristic between the individual microphones will lead to phase problems in the directional system and the directionality will suffer at low frequencies. By means of adjustment of the corner frequencies the filtering in the two microphones can be matched and the directionality can be maintained at low frequencies. This is not possible with present day microphones.

It is the object of the invention to provide a microphone which overcomes the short-comings of a conventional microphone.

SUMMARY OF THE INVENTION

The suggested controllable vent opening attenuates the low frequency sounds entering the microphone according to the equation for $L(\omega)$. This provides attenuation of low frequency noise like wind noise when this is present and to have a high sensitivity in the low frequency region when there is no wind noise.

In an embodiment of the invention a device which is controllable from outside the microphone according to a control signal is provided.

This allows control while the microphone is fully operational or control of the vent opening can be made while the microphone is initialized. For hearing aid microphones such an initialization can take place as a part of a hearing aid fitting procedure.

In an embodiment of the invention the vent opening is located in the microphone membrane. This is an advantage because the membrane is often very thin and the opening is easily provided. The device for adjusting the size of the vent-opening may be located next to the membrane.

In another embodiment the opening and the control means are placed next to the microphone membrane. This is an advantage because hereby the adjustment means will not disturb the sensitive membrane structure.

In a further embodiment the ventilation opening and the control means are placed in the walls constituting the boundaries of the back volume. The vent opening must connect the internal volume of the microphone—the back volume—with the surrounding air and the placing of the control means far away from the membrane may be advantageous in terms of low noise levels being generated by the means.

Preferably the vent opening and/or the means for controlling the opening comprises one or more elements, which are produced by advanced microfabrication techniques. Such techniques are used for fabrication of components such as accelerometers and pressure sensors known from the automotive industry. This is a way of providing the adjustable ventilation opening in a cheep and industrialized way.

In an embodiment of the invention the externally controllable device is an electro-statically actuated, mechanical device. Essentially, this device functioning as a MEMS (Micro-Electro-Mechanical System) valve. Such a MEMS valve is easy to realize in the MEMS technology and it is very reliable.

Preferably the means for controlling the vent-opening comprises a movable valve part suspended in cantilever fashion above a surface of the opening. The movable valve part is capable of blocking (and unblocking) the vent opening, and thereby changing the effective ventilation of the microphone.

The MEMS valve can be fabricated using a combination of photolithography, silicon deep reactive ion etching (DRIE) and wet chemical etching. A photolithographic step defines the structure of the MEMS shutter. The patterned photoresist layer is used as a mask for silicon DRIE, thus transferring the desired shutter design into the silicon. The silicon DRIE process uses a sacrificial layer as an etch stop, e.g. a buried silicon dioxide as inherently present in a silicon-on-insulator (SOI) wafer. The MEMS shutter can be released by wet chemical etching of the sacrificial layer. The gap between the suspended shutter and the underlying silicon surface is precisely determined by the thickness of the sacrificial layer.

In an embodiment of the invention the MEMS shutter is positioned on the backside of the microphone.

In a further embodiment of the invention the microphone comprises a membrane and a back plate, which is generated using MEMS technology. According to this embodiment an atmospheric relief opening or vent opening is provided from a back chamber to the surroundings, where means are provided for controlling the vent opening. In such a microphone which is manufactured in MEMS technology the realization of the controllable vent-opening is especially simple, as this can be done along with the production of the various other microphone parts.

In an embodiment of the invention the means for controlling the vent opening is a MEMS valve fabricated on the membrane side of the microphone in vicinity of the microphone membrane. This embodiment of the invention has the advantage of being easily compatible with existing silicon microphone production technologies (through which the ventilation hole in the membrane is already provided). In order to allow implementation of the present invention the traditional silicon microphone layout has to be slightly modified. The modification implies the addition of a small, fixed membrane area with a ventilation hole located at the edge of the active (moving) membrane area itself. The MEMS valve is fabricated on the surface of the membrane side of the microphone using a combination of photolithography and silicon DRIE. The movable part of the valve is designed to overlap the ventilation hole located at the outer, fixed part of the membrane area In an embodiment of the invention the means for controlling the vent opening is fabricated on the backside of the microphone in the silicon wafer constituting the lower part of the back volume. In this approach the cavity for the lower part of the back volume, the ventilation opening hole and the MEMS-fabricated control means is fabricated in one process flow; preferably in a SOI wafer.

DESCRIPTION OF PREFERRED EMBODIMENTS

The adjustable vent opening can be operated by an electrical control signal whereby the high pass filter function of the microphone device is changed from a very low corner frequency to a substantially higher corner frequency.

In an embodiment of the invention the MEMS adjustable vent opening is fabricated on the backside of the microphone in the silicon wafer constituting the lower part of the back volume.

Figure 1:
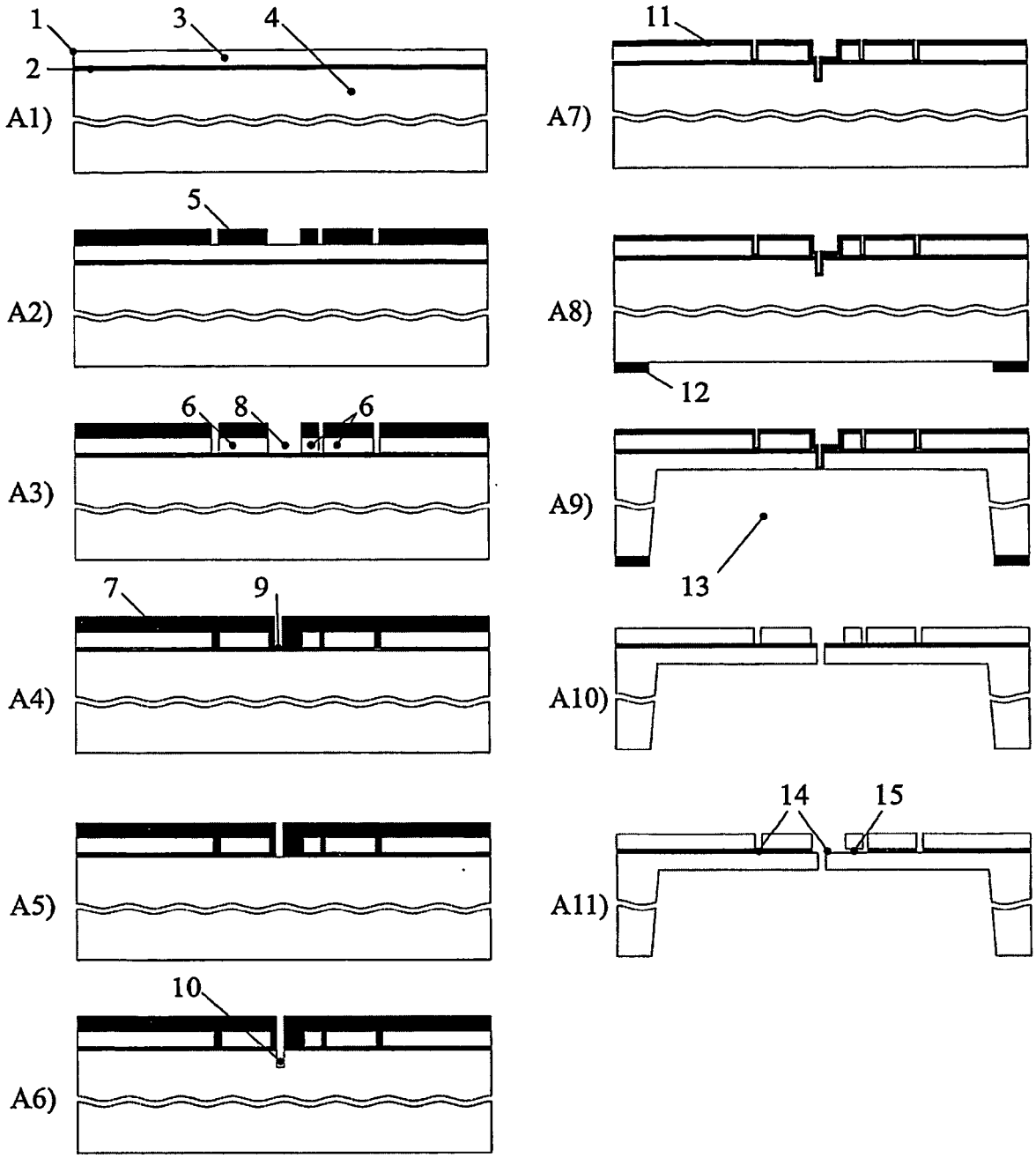
FIG. 1 shows process steps A1 to A11 for generating the controllable device, FIG. 2 displays yet a further alternative process with steps B1 to B9 for generating a controllable device.
Figure 2:
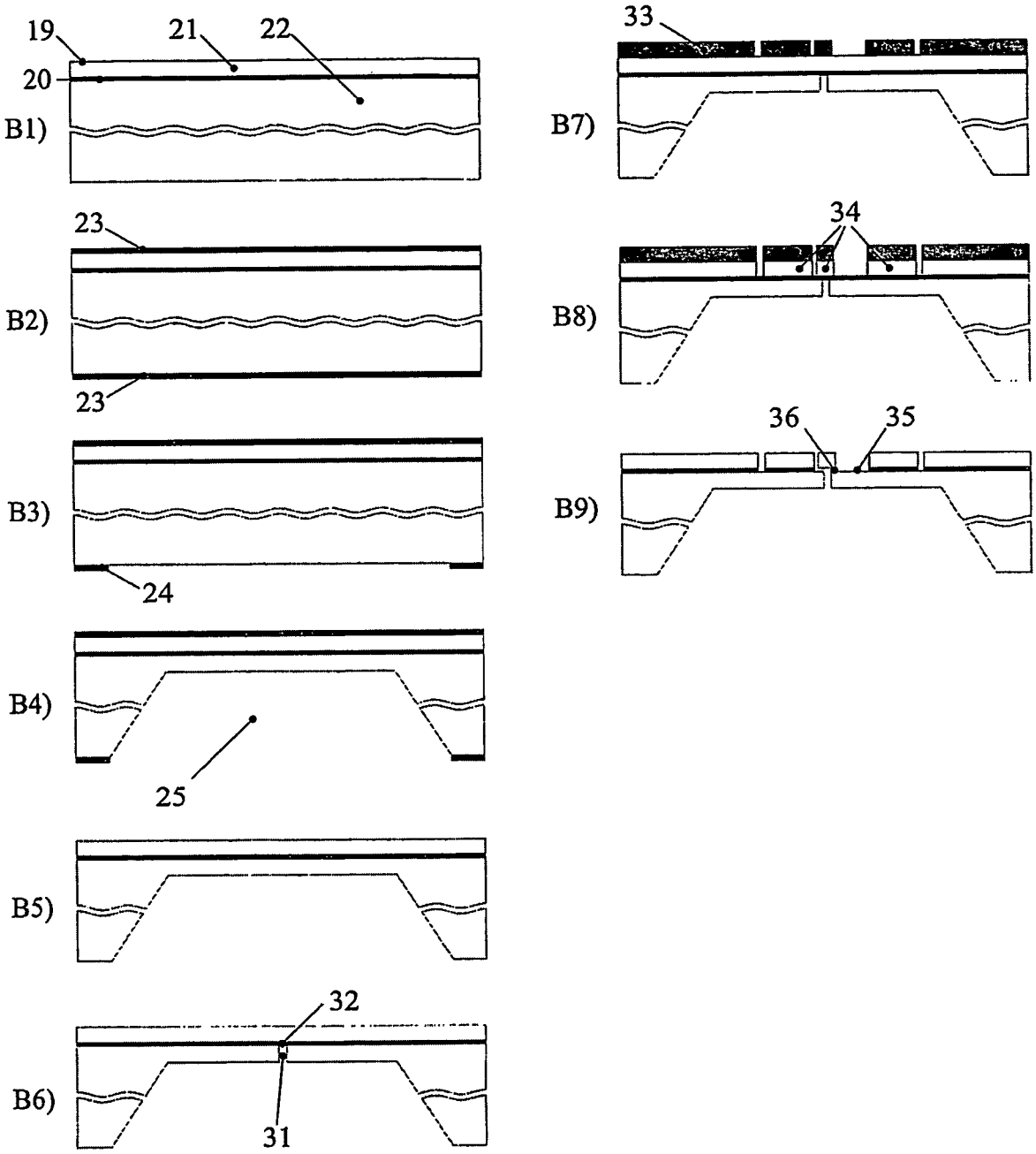

FIGS. 1 and 2 illustrate different process schemes for the production of an adjustable vent opening are presented as examples of possible ways of manufacture the adjustable vent opening.

A1) SOI wafer:

Preferably the silicon wafer 1 is a silicon-on-insulator (SOI) wafer having a buried silicon dioxide layer 2 separating the device silicon layer 3 from the bulk silicon of the wafer 4.

A2) Photolithography on device side of SOI wafer:

In a photolithographic step a photoresist mask 5 defining the structure of the MEMS shutter is formed. Preferably a standard photoresist thickness (e.g., 1.5 μm, AZ5214E) is used.

A3) Silicon DRIE of shutter structure:

Using the patterned photoresist layer 5 as an etch mask the structure of the MEMS shutter 6 is transferred into the silicon device layer by silicon DRIE. The silicon DRIE process uses the buried oxide layer as an etch stop. By proper process optimization uncontrolled etching effects of the silicon near the oxide interface can be avoided (normally referred to as notching effects), thus leading to perfectly defined silicon structures.

After silicon DRIE the photoresist mask is stripped.

A4) Photolithography on device side of SOI wafer:

In a photolithographic step a photoresist mask 7 defining the ventilation hole is formed. The ventilation hole is defined in an area where the silicon device layer of the SOI wafer previously has been removed 8. Thus, the photoresist mask defining the ventilation hole covers the previously defined silicon structures, while exposing a small part of the buried oxide layer 9.

A5) RIE of buried silicon dioxide:

The exposed part of the buried oxide layer is removed in a RIE process.

A6) Silicon DRIE of ventilation hole:

Using the same photoresist mask as used in step e) the ventilation hole 10 is formed in a silicon DRIE process.

A7) Deposition of PECVD silicon oxide on device side of SOI wafer:

A PECVD silicon oxide film 11 is deposited on the device side of the SOI wafer in order to protect the shutter structures from being damaged in the subsequent process steps. A film thickness of 0.5-1 μm is sufficient.

A8) Photolithography on bulk silicon side of SOI wafer:

The cavity for the lower part of the back volume of the microphone is formed in the bulk silicon of the SOI wafer. In a photolithographic step on the bulk silicon side of the SOI wafer a photoresist mask 12 defining the desired structure of the cavity is formed. Preferably a thick photoresist layer (e.g., 9.5 μm, AZ4562) is used.

A9) Silicon DRIE of cavity for the lower part of the back volume:

The cavity 13 for the lower part of the back volume of the microphone is formed in a silicon DRIE process using the thick photoresist layer as an etch mask.

A timed etch stop is used in the etch process. The final etch depth has to be sufficient to ensure proper contact with the predefined ventilation hole 10 on the opposite side of the SOI wafer.

After silicon DRIE the photoresist mask is stripped.

A10) Removal of PECVD silicon oxide on device side of SOI wafer:

The PECVD silicon oxide 11 protecting the shutter structures on the device side of the SOI wafer is stripped using a suitable oxide etchant such as buffered hydrogen fluoride. Removal of the PECVD silicon oxide has the additional effect of opening the ventilation hole.

A11) Release etching of shutter structures:

By prolonged etching in the oxide etchant the shutter structures are subsequently released by etching of the buried oxide layer 14. The gap 15 between the suspended shutter and the lower silicon surface (the bulk silicon of the SOI wafer) is precisely determined by the thickness of the buried oxide layer.

The cavity for the lower part of the back volume of the microphone can also be fabricated by use of wet chemical etching using, e.g., KOH. In this case a suitable etch mask such as LPCVD silicon nitride has to be used and the process sequence A1)-A11) described above will then be changed accordingly.

An alternative process for fabrication of the MEMS shutter on the backside of the microphone is described in the following with reference to FIG. 2. In this embodiment of the invention the ventilation hole is defined from the bulk silicon side of the SOI wafer.

B1) SOI wafer:

Preferably the silicon wafer 19 is a silicon-on-insulator (SOI) wafer having a buried silicon dioxide layer 20 separating the device silicon layer 21 from the bulk silicon of the wafer 22.

B2) Deposition of LPCVD silicon nitride:

LPCVD nitride 23 is deposited simultaneously on both sides of the wafer, thus providing the required protection of the device silicon layer on one side of the SOI wafer as well as an etch mask material for wet chemical etching of the cavity on the second side. A film thickness of 0.5-1 μm is sufficient.

B3) Photolithography on bulk silicon side of the SOI wafer and RIE etching of nitride:

The LPCVD nitride etch mask 24 is patterned using a combination of photolithography and RIE. A photolithographic step on the bulk silicon side of the SOI wafer defines the desired structure of the cavity. Preferably a thin photoresist layer (e.g., 1.5 μm, AZ5214E) is used. The photoresist mask is subsequently used for RIE etching of the LPCVD nitride, thus transferring the desired etch mask pattern into the LPCVD nitride.

The photoresist mask is stripped.

B4) Wet chemical etching of cavity for the lower part of the back volume:

The cavity 25 for the lower part of the back volume of the microphone is formed in a KOH etching process using the patterned LPCVD silicon nitride as an etch mask. A timed etch stop is used in the etch process.

B5) Removal of LPCVD silicon nitride on both sides of the SOI wafer:

The LPCVD silicon nitride defining the cavity etch mask on one side and the protection layer protecting the silicon device layer on the second side is stripped by wet chemical etching.

B6) Laser drilling of ventilation hole on bulk silicon side of SOI wafer:

The ventilation hole 31 is formed in a mask less process using laser drilling. The laser drilling process uses the buried oxide layer as an etch stop 32.

B7) Photolithography on device side of SOI wafer:

In a photolithographic step a photoresist mask 33 defining the structure of the MEMS shutter is formed. Preferably a standard photoresist thickness (e.g. 1.5 μm, AZ5214E) is used.

B8) Silicon DRIE of shutter structure on device side of SOI wafer:

Using the patterned photoresist layer 33 as an etch mask the structure of the MEMS shutter 34 is transferred into the silicon device layer by silicon DRIE. The silicon DRIE process uses the buried oxide layer as an etch stop. By proper process optimization notching effects can be avoided, thus leading to perfectly defined silicon structures.

After silicon DRIE the photoresist mask is stripped.

B9) Release etching of shutter structures:

By prolonged etching in the oxide etchant the shutter structures are subsequently released by etching of the buried oxide layer 35. The gap 36 between the suspended shutter and the lower silicon surface (the bulk silicon of the SOI wafer) is precisely determined by the thickness of the buried oxide layer.

Alternatively the ventilation hole can be formed in the bottom of the cavity by a mask less laser drilling process using the buried oxide layer as an etch stop. In this case the cavity can be fabricated by silicon DRIE using a photoresist etch mask, and the need for metal layers in the cavity as well as electrodeposited photoresist can be avoided.

Figure 3:
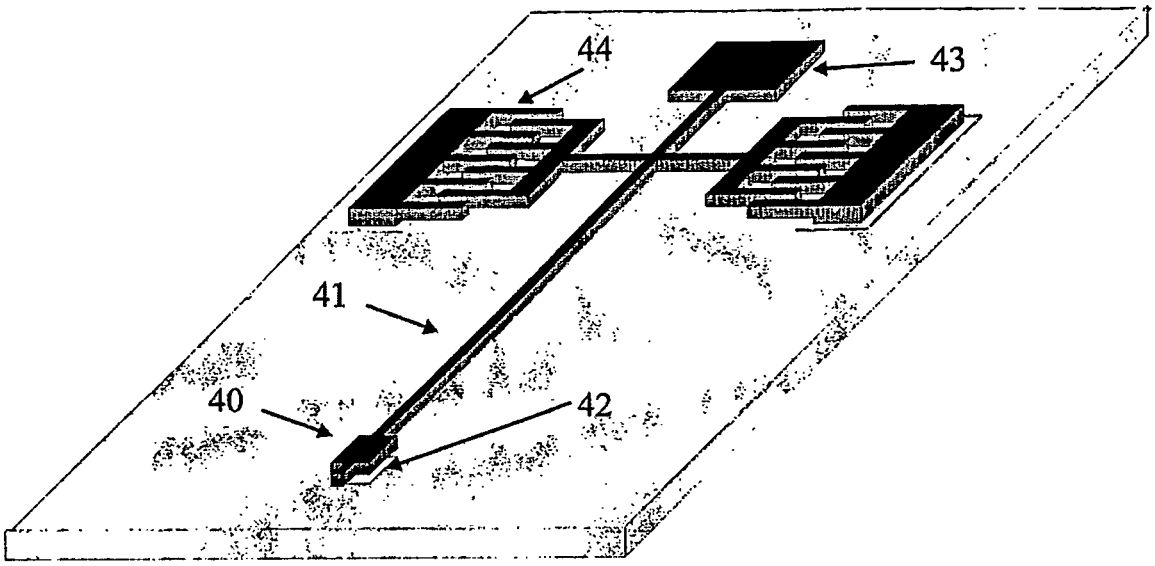
FIG. 3 shows a perspective view of a controllable vent opening as it would appear if generated according to the processes described processes.

In FIG. 3 a control means as it would appear when generated with one of the above processes is shown. A movable valve 40 is suspended on a cantilever 41 above the vent opening 42. The cantilever 41 is anchored at an anchor part 43. Electrostatic comb-drives 44 are realized at each side of the cantilever and 41 and in connection therewith. By regulation of the voltage on the comb-drives 44, the cantilever 41 can be moved and a smaller or larger part of the vent opening 42 is exposed. This will cause the acoustic properties of the microphone to change.

Figure 4:
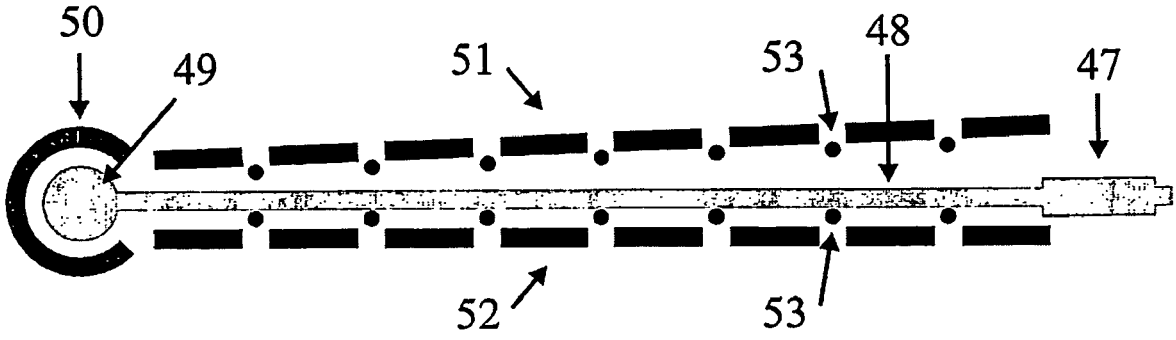
FIG. 4 is a schematic representation of a further embodiment of the controllable device.

FIG. 4 displays an alternative embodiment, where the cantilever is replaced by a loose element, which has a valve or shutter part 47, a beam part 48 and an anchor part 49. The anchor part 49 is releasable from a gripper part 50 when the voltage is applied to the gripper part 50. Electrodes 51, 52 on each side of the beam part 48 may move the beam part to either side depending on the voltage difference applied to them.

Also stoppers 53 are provided in order to prevent direct contact between the beam part 48 and the electrodes 51, 52. This embodiment has the advantage that it is not energized unless the shutter has to be moved.

The range of adjustment of the corner frequency is limited by the application for which the microphone developed according to the present invention is intended. The technical specifications of the microphone device may, however, have to be optimized for a specific acoustic corner frequency, meaning that the details of the microphone are designed according to this corner frequency. Hence the microphone can be used for the entire range of corner frequencies but will not have optimum performance for other corner frequencies.

The electrically controlled adjustment can be used while the microphone is fully operational or it can be used when the microphone is in a non-operational state. The advantage of changing the acoustic properties of the microphone as acoustic signals are received, is that it will allow an adaptive use of the microphone influenced by the received acoustic signals. This adaptive use of the device may however cause noise in the microphone during adjustment of the ventilation opening either in the form of electrical disturbance or in the form of acoustic signals introduced in the back chamber whenever the opening is adjusted.

If the use of microphones according to the invention is limited to adjustment of the properties of the microphone when the microphone is not in a fully operational state, a valve-design which creates more electrically induced or acoustically generated noise can be allowed, and such a valve is easier to design and manufacture.

Even if this does not allow instantaneous microphone adjustments according to the present acoustic signal, such a use of the invention still allows specific adjustments associated with the intended use of the microphone, e.g., in a hearing aid fitting procedure.

The invention claimed is:

1. A microphone which comprises a membrane, having a first side in fluid contact with the surroundings and a second side which faces a back chamber, wherein a vent opening is located in the membrane, and including control means for controlling the vent opening.

2. The microphone as claimed in claim 1, where the control means are controllable from outside the microphone by a control signal.

3. The microphone as claimed in claim 1, wherein the control means is placed next to the membrane.

4. The microphone as claimed in claim 1, wherein the control means is placed in walls of the back chamber.

5. The microphone as claimed in claim 1, wherein the vent opening and/or the control means comprises one or more elements which are produced by advanced microfabrication techniques.

6. The microphone as claimed in claim 5, whereby the control means comprise an electro-statically actuated, mechanical device.

7. The microphone as claimed in claim 5, whereby the control means comprise a movable valve part suspended in cantilever fashion on or above a surface with the vent opening.

8. The microphone as claimed in claim 5, wherein the control means is positioned on the backside of the microphone.

9. A microphone with a membrane and a back plate, which is generated using MEMS technology, wherein the membrane includes an atmospheric vent opening communicating a back chamber to the surroundings, and including means for controlling the vent opening.

10. The microphone as claimed in claim 9, where the control means are controllable from outside the microphone by a control signal.

11. The microphone Microphone as claimed in claim 9, where the vent opening and wherein the control means are is placed next to the microphone membrane.

12. The microphone Microphone as claimed in claim 9, where the vent opening and wherein the control means are is placed in the walls constituting the boundaries a wall of the back chamber.

13. The microphone Microphone as claimed in claim 9, wherein the means for controlling the vent opening is a MEMS valve fabricated on the membrane side of the microphone in vicinity of the microphone membrane.

14. The microphone Microphone as claimed in claim 9, whereby the control means is fabricated on the backside of the microphone in the silicon wafer constituting the a lower part of the back volume.

15. A microphone which comprises a membrane having a first side in fluid contact with the surroundings and a second side which faces a back chamber, means forming a vent opening between the back chamber and the surroundings, and control means for controlling the vent opening, said control means comprising a movable valve part suspended in cantilever fashion on or above a surface with the vent opening.

* * * * *